US010167598B2

(12) United States Patent
Stemerman et al.

(10) Patent No.: US 10,167,598 B2
(45) Date of Patent: Jan. 1, 2019

(54) SNOW PLOW BLADE

(71) Applicants: Marc Stemerman, Elmira, NY (US); Daren Lynch, Oneida, NY (US); John Cronin, Jericho, VT (US); Michael G D'Andrea, Burlington, VT (US)

(72) Inventors: Marc Stemerman, Elmira, NY (US); Daren Lynch, Oneida, NY (US); John Cronin, Jericho, VT (US); Michael G D'Andrea, Burlington, VT (US)

( * ) Notice: Subject to any disclaimer, the term of this patent is extended or adjusted under 35 U.S.C. 154(b) by 31 days.

(21) Appl. No.: 15/433,485

(22) Filed: Feb. 15, 2017

(65) Prior Publication Data

US 2018/0230660 A1 Aug. 16, 2018

(51) Int. Cl.
*E01H 5/06* (2006.01)

(52) U.S. Cl.
CPC ..... *E01H 5/062* (2013.01)

(58) Field of Classification Search
CPC ..... E01H 5/062; E01H 5/063; E01H 5/06; E01H 5/065; E01H 5/066; E01H 5/068
See application file for complete search history.

(56) References Cited

U.S. PATENT DOCUMENTS 3,888,027 A * 6/1975 Toews ..... E02F 3/8152 172/701.3
5,410,824 A * 5/1995 Pedersen ..... E01H 5/04 37/214
5,638,617 A * 6/1997 Belanger ..... E01H 5/06 37/232
5,743,032 A * 4/1998 Vauhkonen ..... E01H 5/062 172/701.3
7,874,085 B1 * 1/2011 Winter ..... E01H 5/061 172/701.3
2009/0307934 A1 * 12/2009 Wendorff ..... C09D 5/00 37/197
2011/0162241 A1 * 7/2011 Wangsness ..... E01H 5/066 37/266
2013/0212915 A1 * 8/2013 Abramczyk ..... E01H 5/062 37/270
2015/0047234 A1 * 2/2015 Winter ..... E01H 5/061 37/460
2016/0333547 A1 * 11/2016 Winter ..... E02F 3/8152

FOREIGN PATENT DOCUMENTS

WO WO-2017060351 A1 * 4/2017

* cited by examiner

*Primary Examiner* — Jamie L McGowan

(57) ABSTRACT

A snow plow blade, especially a replaceable snow plow blade, that functions to dampen or suppress jolts and vibrations due to forceful contact of the blade with objects.

21 Claims, 11 Drawing Sheets

SNOW PLOW BLADE

FIELD OF THE INVENTION

The present invention relates to a blade for snow plows, especially a blade that functions to dampen or suppress jolts and vibrations induced in the blade due to contact of the blade with types of frozen water, a terrain surface, and other obstacles during use.

BACKGROUND OF THE INVENTION

Snow plow blades are typically attached to the lower edge of a moldboard, which conventionally is configured in a concave, generally semi-cylindrical shape that is used to displace snow, ice, slush, or another form of frozen water from the path of a vehicle to which the moldboard is mounted. Since the snow plow blade is typically attached to the lower edge of a moldboard, the blade absorbs the brunt of forces created when the moldboard is moved forward and encounters various types of frozen water, gravel and other loose objects, and fixed objects such as manhole covers in the path of the vehicle. In addition, the blade is typically positioned relatively close to the underlying terrain surface so that any irregularities in the terrain surface or any bouncing of the moldboard may result in a forceful contact of the blade with the terrain surface as the moldboard moves forward.

When encountering various sources of resistance, the blade jolts and vibrates which movements are transmitted through the moldboard and to the frame connecting the moldboard to the vehicle, and ultimately to the vehicle operator. The forceful contacts and resulting jolts and vibrations tend to damage the blade itself and tend to weaken the connection of the blade to the moldboard. As such, the performance of the blade deteriorates, and so repairs to the blade and its connection to the moldboard are needed. Further, the jolting and vibrations can cause the blade and moldboard together to move in ways that increase contact of the blade with the road or other terrain surface, thereby exacerbating the problems.

SUMMARY OF THE INVENTION

The present invention relates to a snow plow blade, especially a replaceable snow plow blade, that functions to dampen or suppress jolts and vibrations due to forceful contact of the blade with objects.

BRIEF DESCRIPTION OF THE DRAWINGS

The invention will now be described with reference to the accompanying drawings, wherein like reference numerals refer to the same item.

DESCRIPTION OF A PREFERRED EMBODIMENT

Figure 1:
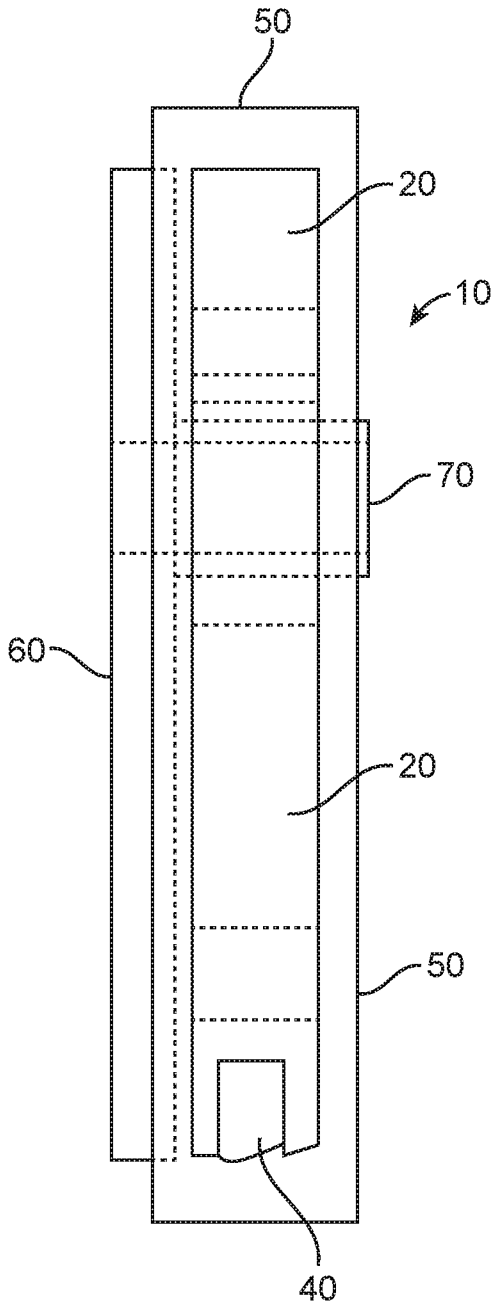
FIG. 1 is a side schematic illustration of a snow plow blade in accordance with one embodiment of the present invention.

The present invention will be described with reference to the accompanying drawings wherein like reference numerals refer to the same item. It should be appreciated that the following description is intended to be exemplary only and that the scope of the invention envisions other variations and modifications of these particular exemplary embodiments.

Figure 2:
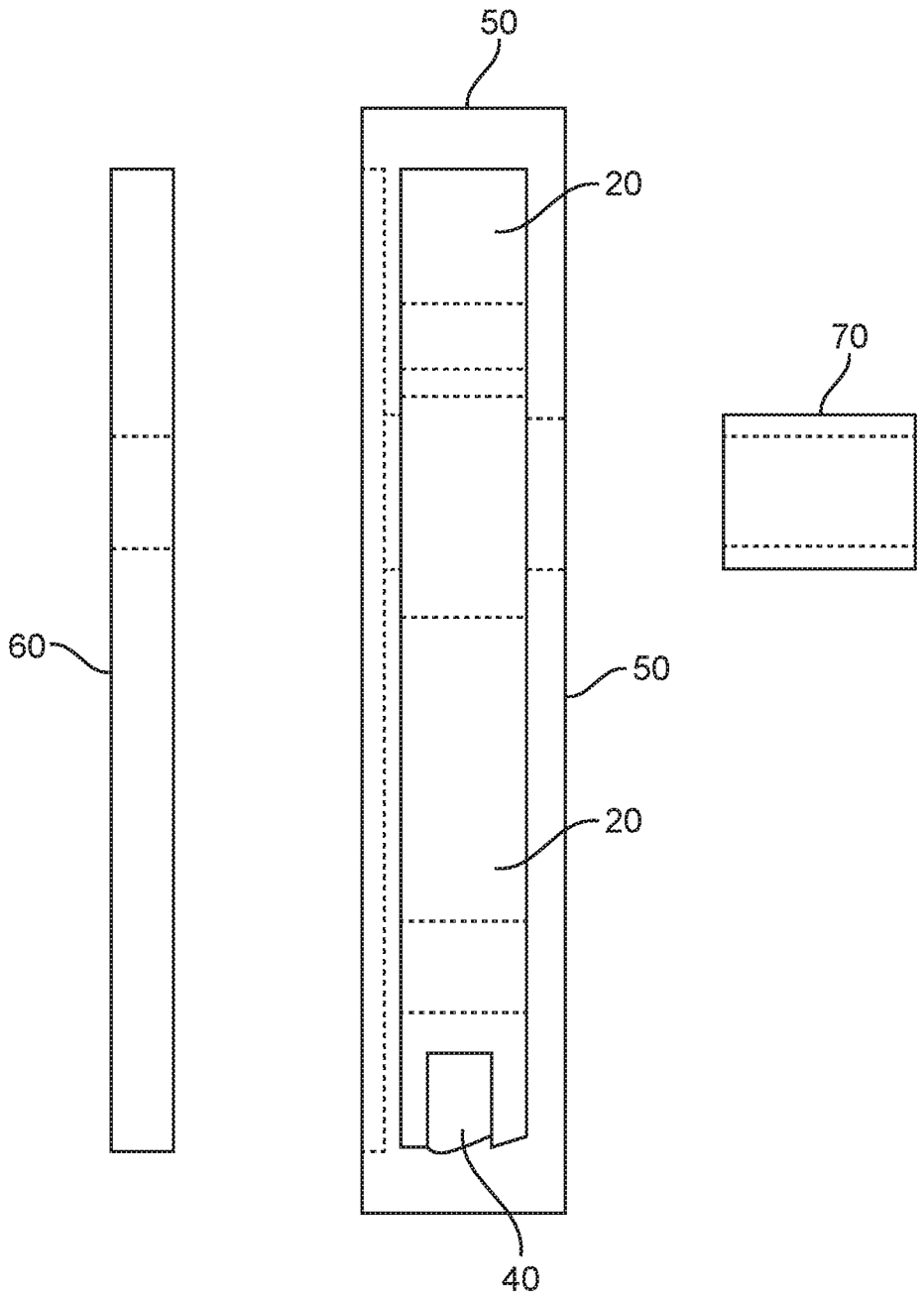
FIG. 2 is a partially exploded side schematic illustration of the snow plow blade shown in FIG. 1.

There is shown in FIGS. 1 and 2 a snow plow blade 10 in accordance with a preferred embodiment of the present invention. The snow plow blade 10 is elongate and is adapted to be mounted to and extend across the lower edge of a moldboard (not shown). Although the blade 10 may be welded or otherwise fixedly secured to the lower edge of the moldboard, very preferably the snow plow blade 10 is selectively and removably mounted to the lower edge of the moldboard with fastening members such as bolts. As such, if the snow plow blade 10 becomes excessively worn or damaged, the snow plow blade 10 may be quickly removed from the lower edge of the moldboard and a second, identical snow plow blade 10 may be interchangeably mounted on the lower edge of the moldboard.

Figure 3:
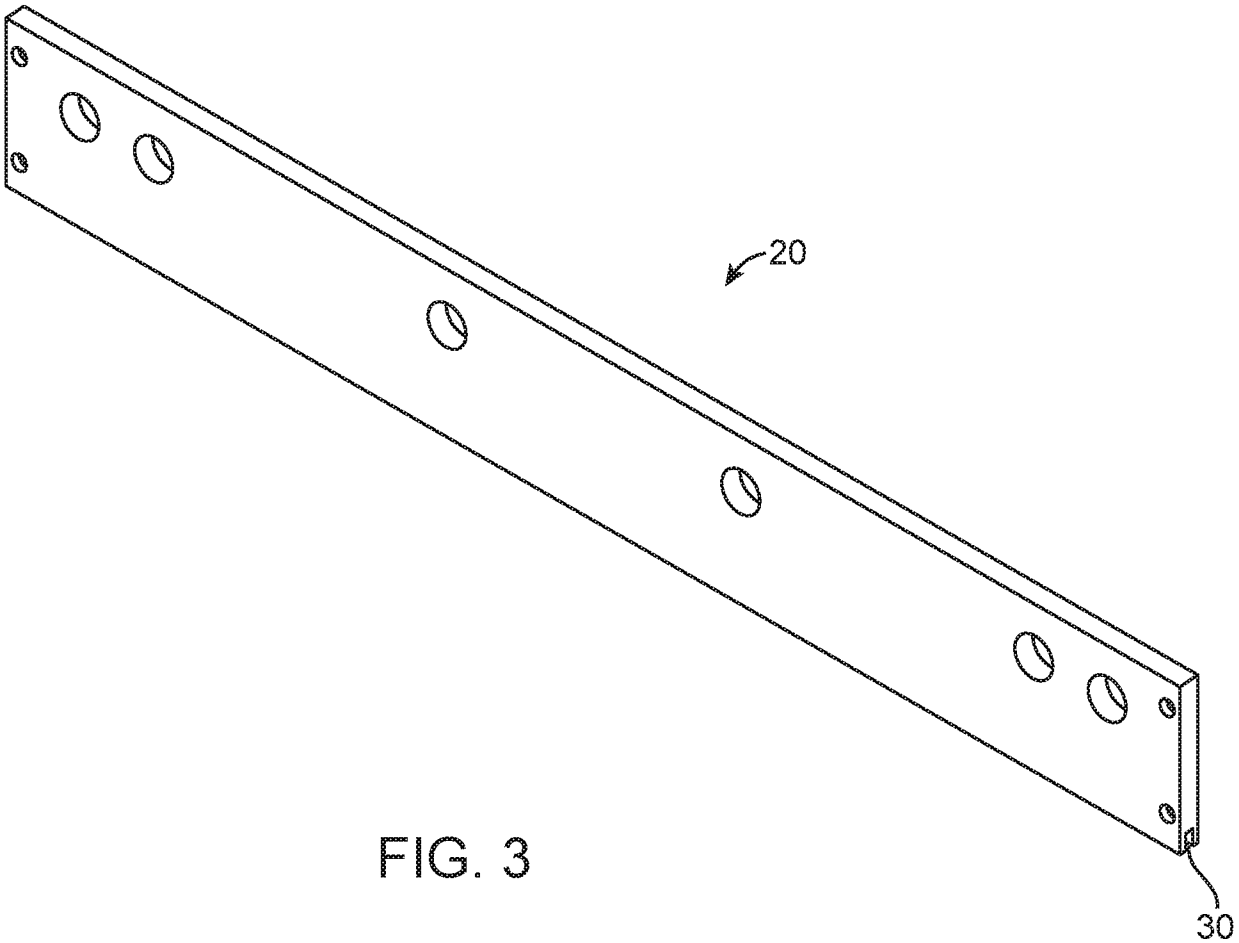
FIG. 3 is a perspective view of a bar employed in the snow plow blade shown in FIGS. 1 and 2.
Figure 4:
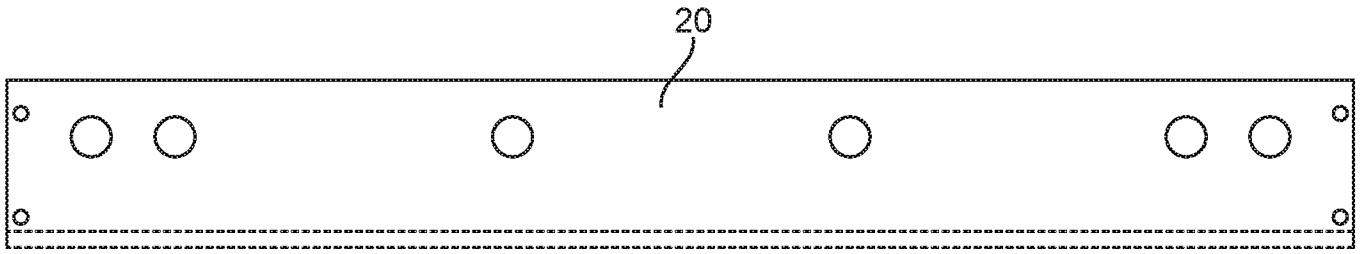
FIG. 4 is a plan view of the bar shown in FIG. 3.
Figure 5:
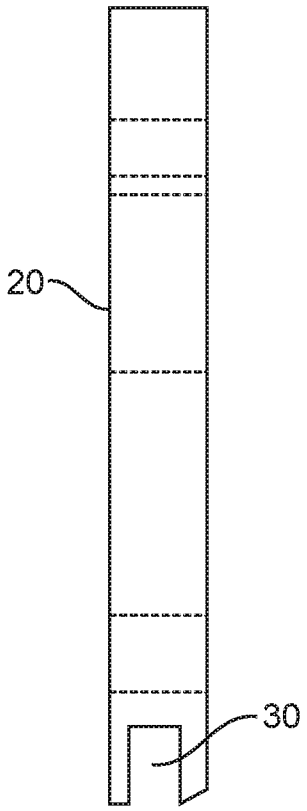
FIG. 5 is a side schematic illustration of the bar shown in FIGS. 3 and 4.
Figure 6:
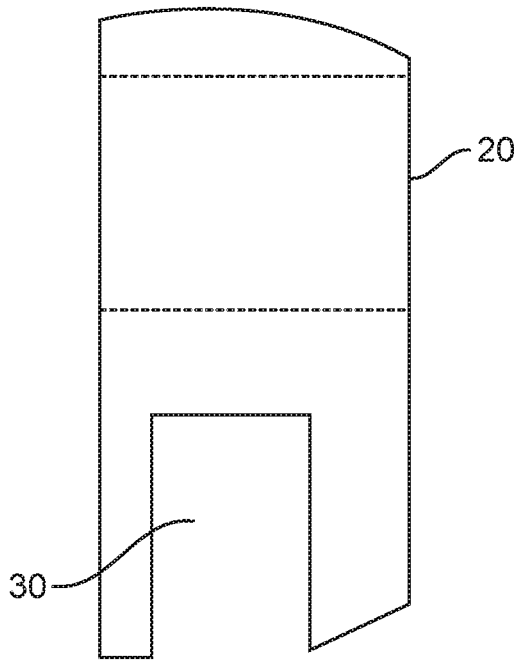
FIG. 6 is a side schematic illustration of the region designated "A" of the bar shown in FIG. 5.

A component of the snow plow blade 10 according to a preferred embodiment comprises an elongate, rigid bar 20 preferably fashioned of a strong metal such as carbide steel, as shown in FIGS. 3-6. The bar 20 is preferably fashioned in the shape of a rectangular cuboid. The bar 20 possesses a front surface possessing a rectangular, planar shape, a back surface possessing a rectangular, planar shape, a top surface possessing a rectangular, planar shape, a bottom surface possessing a rectangular, planar shape in which a "U"-shape groove 30 is disposed therealong, a first end surface possessing a rectangular, planar shape, and a second end surface possessing a rectangular, planar shape. The front surface and the back surface are parallel, the top surface and the bottom surface are parallel, and the first end surface and the second end surface are parallel. All of the bar surfaces join and intersect at right angles. As best shown in FIGS. 3 and 4, the bar 20 possesses a series of six spaced apertures extending transversely therethrough, at a location approximately two-thirds of the distance from the lower surface to the upper surface of the bar 20. Each aperture is adapted to selectively receive a fastening member, such as a bolt, therethrough, as will be explained in more detail later.

The bar 20 also possesses a pair of spaced through-holes disposed near each of the first end surface and the second end surface, extending transversely therethrough, that are adapted to receive an elastomeric material therethrough in a liquid form, which later cures or hardens, and helps to secure the elastomeric material to the bar 20.

A component of the snow plow blade 10 also comprises an elongate, rigid cutting edge 40 preferably fashioned of a very strong metal, such as carbide steel. The dimensions of the cutting edge 40 are such that the peripheral walls of the cutting edge 40 conform with the walls of the "U"-shape groove 30 so that the cutting edge 40 may be snuggly received within the "U"-shape groove 30. Preferably the cutting edge 40 is retained within the "U"-shape groove 30 by compression between the lateral walls of the cutting edge 40 and the lateral walls of the "U"-shape groove 30, also known as a "press-fit" connection. In such a connection, the transverse dimension of the cutting edge 40 is very slightly wider than the width between the lateral walls of the "U"-shape groove 30. Also preferably, the cutting edge 40 extends along the entire length of the "U"-shape groove 30.

As best shown in FIGS. 1 and 2, the dimensions of the cutting edge 40 are selected such that the lowest point of the cutting edge 40 depends below the lower surface of the bar 20. Also, as best shown in FIGS. 1 and 2, the cutting edge 40 is beveled upwardly from front to back. Also preferably, the back portion of the lower surface of the bar 20 is likewise beveled upwardly from front to back. Further preferably, the beveled surface of the cutting edge 40 and the beveled edge of the back portion of the lower surface of the bar 20 are co-planar and co-extensive.

Typically a snow plow blade 10 will be mounted on the lower edge of the moldboard at a slight angle to the vertical, and the angle of beveling of the cutting edge 40 and the back portion of the lower surface of the bar 20 are selected so that the plane of the beveled surfaces will be substantially horizontal when the snow plow blade 10 is mounted on the lower edge of the moldboard. A preferred angle of beveling is from five to thirty degrees.

Figure 7:
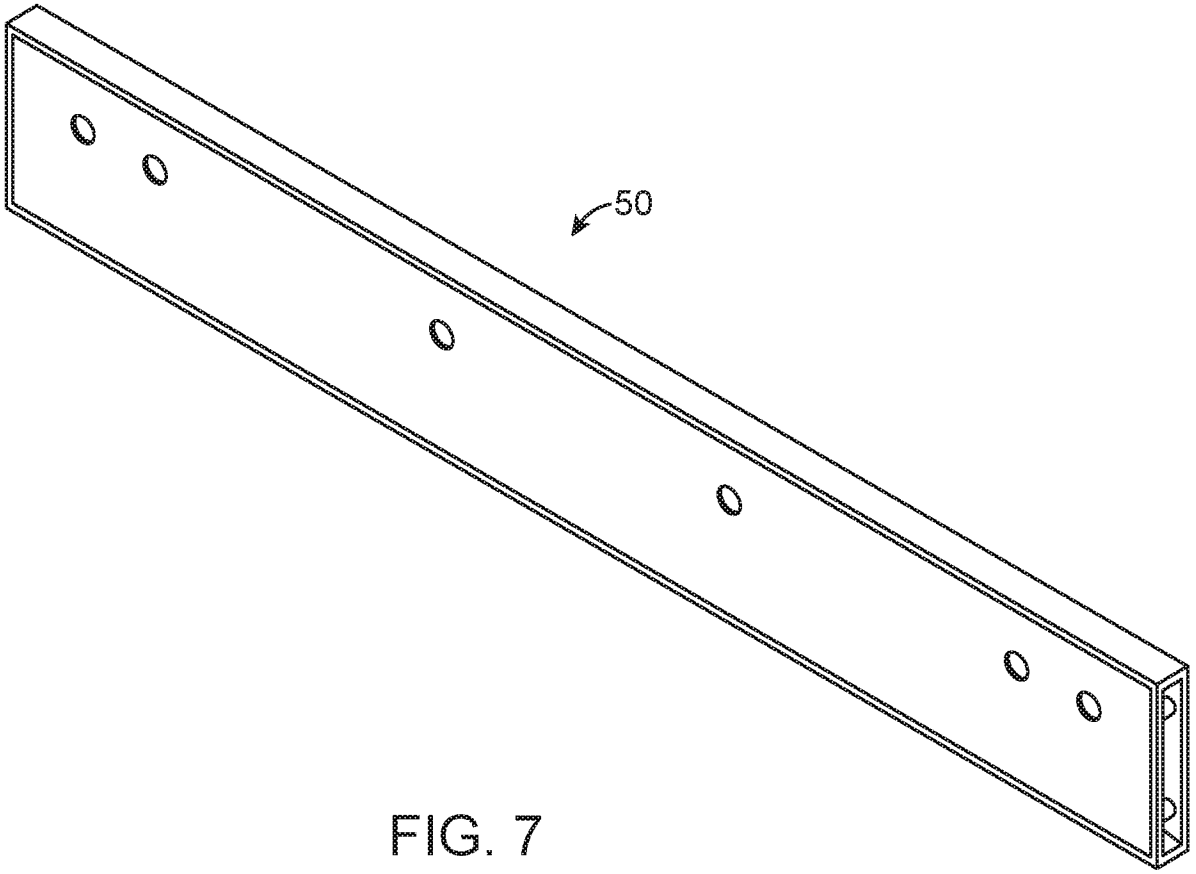
FIG. 7 is a perspective view casing of elastomeric material employed in the snow plow blade shown in FIGS. 1 and 2.

Another component of the snow plow blade 10 comprises an elongate casing 50 formed of elastomeric material, such as a polyurethane or rubber. In a preferred embodiment, the outer periphery of the elastomeric material casing 50 also is configured in the general shape of a rectangular cuboid. The casing 50 preferably completely surrounds the bar 20, in particular, the front and back surfaces and the top and bottom surfaces of the bar 20. The casing 50 includes a front surface possessing a rectangular and generally planar shape, a back surface possessing a rectangular, planar shape, a top surface including a rectangular, planar shape, and a bottom surface possessing a rectangular, planar shape. The front surface and the back surface are generally co-planar, and the top surface and the bottom surface are co-planar. In a preferred embodiment, the first end and the second end of the casing 50 are generally open. As best shown in FIG. 7, the casing 50 in a preferred embodiment includes studs that extend through the pairs of through-holes disposed adjacent to the first end and the second end of the bar 20. Both the front wall and the back wall of the casing 50 include a series of six spaced apertures each adapted to align with a corresponding aperture in the bar 20 when the bar 20 is encased within the casing 50. The front surface of the casing 50 includes a peripheral, traversely extending, protruding rim that forms a central, rectangular shape recessed region in the front surface.

Although the casing 50 of the elastomeric material is preferably fashioned of a unitary, integral material, the invention contemplates that different types of elastomeric material may form the casing and that the casing may be formed in segments or portions. The casing 50 is preferably formed by depositing the bar 20 in a vat or mold of liquid elastomeric material, then permitting the elastomeric material to cure or harden. In such a method, the elastomeric material may flow into the through-holes in the bar 20, thereby forming interior studs of elastomeric material to help secure the casing 50 to the bar 20. It will be appreciated that through such a manufacturing process, the casing intimately contacts the entire front surface, the entire back surface, the entire top surface, and the entire bottom surface of the bar 20. The degree of contact includes those described as a "bond" between the elastomeric material and the bar 20 or an "adhesion" of the elastomeric material to the bar 20.

Figure 8:
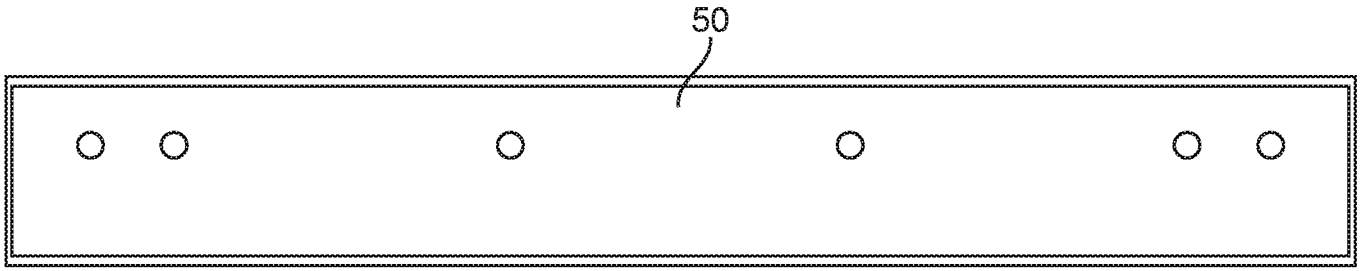
FIG. 8 is a plan view of the casing of elastomeric material shown in FIG. 7.
Figure 9:
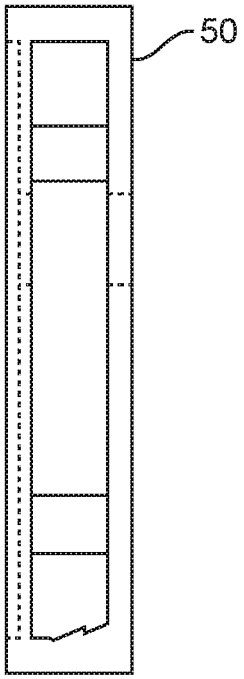
FIG. 9 is a side schematic illustration of the casing of elastomeric material shown in FIGS. 7 and 8.
Figure 10:
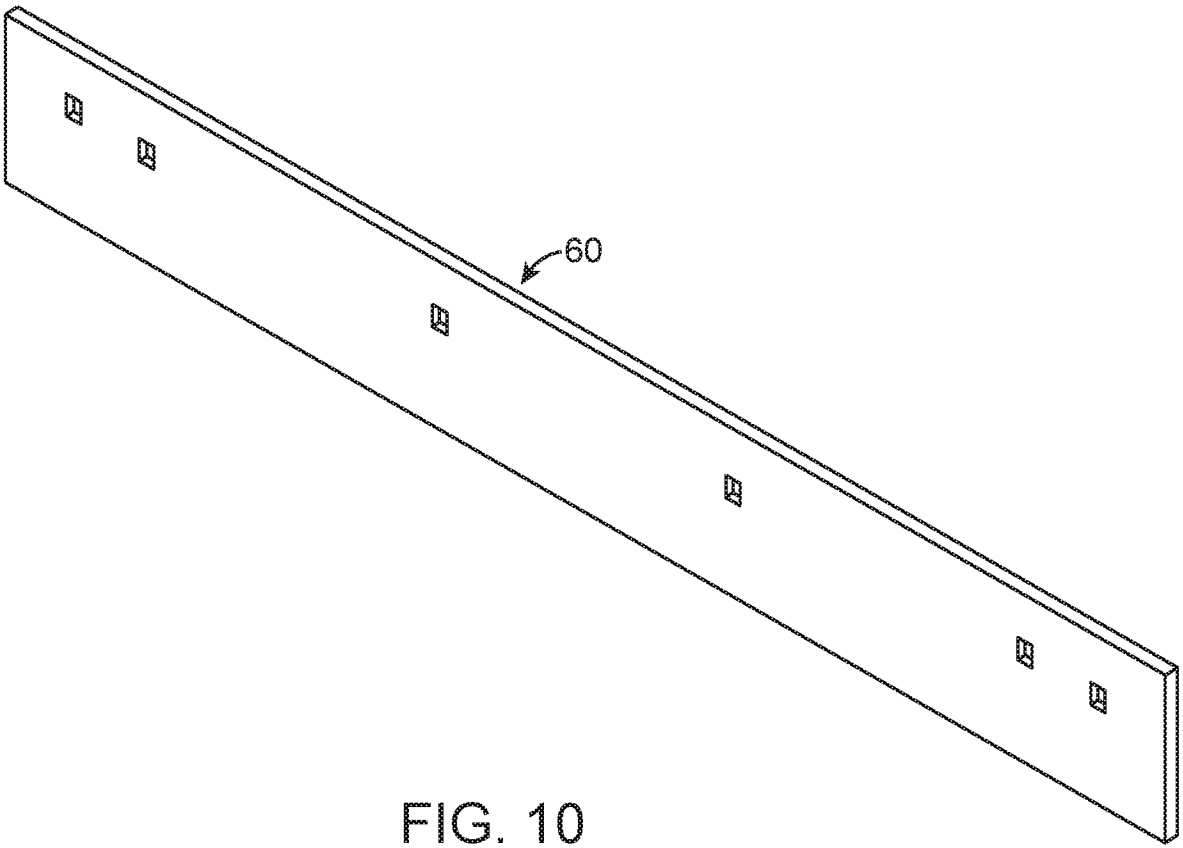
FIG. 10 is a perspective view of a cover plate employed in the snow plow blade shown in FIGS. 1 and 2.
Figure 11:
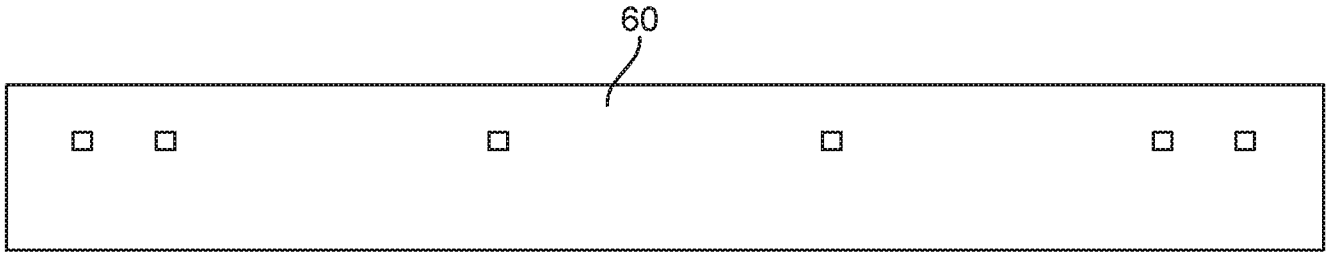
FIG. 11 is a plan view of the cover plate shown in FIG. 10.

Another component of the snow plow blade 10 comprises an elongate, rigid cover plate 60 as best shown in FIGS. 10 and 11. The cover plate 60 is also fashioned as a rectangular cuboid, and possesses a front surface possessing a rectangular, planar shape, a rear surface possessing a rectangular, planar shape, a top surface possessing a rectangular, planar shape, a bottom surface possessing a rectangular, planar shape, a first end surface possessing a rectangular, planar shape, and a second end surface possessing a rectangular, planar shape. The front surface and the back surface are parallel, the top surface and the bottom surface are parallel, and the first end surface and the second end surface are parallel. All of the plate surfaces join and intersect at right angles. The height and length of the cover plate 60 are selected so as to be conformingly received in the recessed area on the front surface of the elastomeric covering 50 defined by the transversely protruding, peripheral rim. As best shown in FIGS. 1, 7, and 8, the invention contemplates that the cover plate 60 and the bar 20 may together be deposited in the vat or mold of liquid elastomeric material, which is then hardened or cured. As such, the back surface, the top surface, the lower surface, the first end surface, and the second end surface of the cover plate 60 are not only in intimate contact with the covering 50, but also may be in such a degree of contact that they are said to be bonded or adhered together.

As shown in FIGS. 10 and 11, the cover plate 60 also possesses a series of six apertures that co-align with the apertures in the bar 20 and the apertures in the casing 50. These co-aligned apertures each extend traversely through the snow plow blade 10 and are adapted to selectively receive therethrough a fastening member such as a bolt. The apertures in the cover plate 60 are preferably configured so as to be square, rather than circular, as are the apertures in the bar 20 and the casing 50. It will be appreciated that, when employing a bolt comprising a head, a neck portion that possesses a square periphery, and a threaded shank portion, the head of the bolt will rest forcibly against the front surface of the cover plate 60, the neck portion of the bolt will conformingly fit within the square aperture of the cover plate 60, and the shank portion of the bolt will extend through the corresponding, co-aligned apertures in the bar 20 and the casing 50 and will further extend into corresponding apertures (not shown) in the lower edge of the moldboard. A nut or a combination of one or more nuts and washers, may be threadably, forcefully mounted on the threaded shank portion of the bolt extending through to the rear side of the lower edge of the moldboard, thereby selectively and removably securing the snow plow blade 10 to the lower edge of the moldboard. When the nut or the combination of one or more nuts and washers are threadably secured to each bolt, the disposition of the neck portion of the bolt in the square aperture of the cover plate 60 will prevent the bolt from rotating within the aperture, and thus will help facilitate the tightening of the nut or the combination of one or more nuts and washers on the threaded portion of the shank.

The cover plate 60 is preferably fashioned of a strong material, such as metal, preferably such as steel. The cover plate 60 is positioned so as to contact the snow, ice, slush, or other frozen water and to contact gravel or other loose obstacles in the path of the snow plow blade 10. In some contrast, the cutting edge 40 is positioned so as to break up ice or compacted snow and to contact the terrain surface underlying the blade and the moldboard, such as a road or an airport runway. It would be appreciated that, during use, the portion of the casing 50 disposed below the cutting edge 40 will wear away relatively quickly and thus expose the cutting edge 40 as well as the lower surface of the bar 20 and the lower surface of the cover plate 60.

The snow plow blade 10 according to a preferred embodiment also includes a plurality of hollow, cylindrical bushings 70, as best shown in FIGS. 1 and 2. Each bushing is adapted to extend through a corresponding set of co-aligned apertures in the bar 20 and the casing 50 and to receive a fastening member, such a bolt, therethrough. Each bushing 70 is preferably fashioned of metal and may be secured within each set of co-aligned apertures by an adhesive. More preferably each bushing 70 is or may be positioned within the mold of liquid elastomeric material such that the elastomeric material hardens or cures around each bushing 70. The outside diameter of each bushing is approximately equal to the diameter of each aperture in the casing 50, however, the diameter of each aperture in the bar 20 is slightly larger than the outside diameter of each bushing. Such a design permits some "play" or wobbling between the bushing 70 and the bar 20 and thus also some play or wobbling between the casing 50 and the bar 20. The gap between the outer peripheral surface of the bushing 70 and the peripheral wall defining the corresponding operative in the bar 20 through which the bushing 70 extends may be filled with elastomeric material either coated on the bushing 70 prior to insertion of the bushing 70 through the corresponding aperture or formed as part of the elastomeric material casing 50. The interposition of such an elastomeric material between the bushing 70 and the bar 20 helps to dampen any jolts or vibrations of the blade 10 and helps to diminish any direct, forceful contact between the bushing 70 and the bar 20 that could cause wear or breakage of the bushing 70.

The backwardly extending edge of each bushing 70 preferably extends very slightly beyond the back surface of the casing 50 whereas the frontwardly extending end of each bushing abuts the back surface of the cover plate 60. As such, the bushing 70 may provide a strong, secure rigid connection between the cover plate 60 and the lower edge of the moldboard while permitting some movement of the bar 20 and some deformation or movement of the casing 50. Also, it will be appreciated that the back surface of the casing 50 is very closely proximate to at least a portion of the lower edge of the moldboard and thus provides a resilient compression against the lower edge of the moldboard when forces act on the snow plow blade 10.

The interposition of elastomeric material between the cover plate 60 and the bar 20 and the interposition of elastomeric material between the bar 20 and the lower edge of the moldboard help to absorb and dampen forces acting upon the cover plate 60 and on the cutting edge 40 and also to suppress vibrations of the snow plow blade 10 and to diminish transmission of those forces to the moldboard. It will also be appreciated that a force may act on the cutting edge 40 without equally acting on the cover plate 60 and that the elastomeric material helps to dampen those forces and to suppress vibrations due to those forces as well.

Variations of a preferred embodiment are naturally contemplated by the invention. For example, either or both the bar 20 and the cover plate 60 may be segmented. Also, the elastomeric material might cover only the front surface and the back surface of the bar 20, or only the front surface or only the back surface of the bar 20, or only portions of those surfaces. The number of apertures, instead of being six as shown in the drawings, may be anywhere from four to twelve or less preferably another number outside that range. The carbide edge 40 may be eliminated from the design, and instead, the lower surface of the bar 20 may be formed with a cutting edge. As another example, the configurations of the bar 20 and the cover plate 60 may be other than a rectangular cuboid, and may be provided with one or more wavy, angled, serrated, or pitted surfaces.

The invention also contemplates that the front surface of the bar 20, the back surface of the bar 20, or both may be formed with a series of spaced ridges. The ridges on each surface may be parallel to each other and may be equidistantly spaced from each other. The ridges may have a square-tooth, a saw-tooth, or a rounded profile or another profile shape. The ridges may extend in a vertical direction, a horizontal direction, or a diagonal direction, or in another direction. The ridges may extend over the entire surface or only across one or more portions of the surface. It is thought that when the elastomeric material of the casing 50 extends into the interstitial region between the ridges in a series of ridges, both the casing 50 will be more securely bonded or adhered to the bar 20 and the elastomeric material will be more effectively utilized in providing a increased dampening effect on jolts and vibrations of the blade 10.

Although the dimensions of a preferred bar 20 may be forty-eight inches by six inches by three-quarters of an inch, other dimensions may also work advantageously. Likewise, the dimensions of a preferred cover plate 60 may be forty-seven and a half inches by six inches by thirty-eight hundredths of an inch, other dimensions may also be employed advantageously. Similarly, although the apertures in the bar 20 may be one and a half inches in diameter, the apertures in the casing 50 may be ninety-four hundredths of an inch in diameter, and the exterior diameter of each bushing may be ninety-four hundredths of an inch in diameter, other diameters of the apertures and the bushings may also function sufficiently. The recess in the front surface of the casing 50 is preferably thirteen hundredths of an inch deep; however, other dimensions may also perform well. As another example, the protruding peripheral rim on the front surface of the casing 50 may itself possess a thickness of thirty-eight hundreds of an inch or another dimension. Further, although the thickness of the elastomeric material in the casing 50 may range from one-quarter of an inch to fifty-one hundreds of an inch, other thicknesses will also work well, such as one-half inch to one inch.

The length of the bar 20 may be in the range of one to five percent greater than the length of the cover plate 60, and the width of the bar 20 may be in the range of four to fifteen percent greater than the width of the cover plate 60. Other percentages may also work advantageously.

The invention also contemplates that one or more accelerometers, or other devices for monitoring movement or vibration of the blade 10 may be mounted on the blade 10, such as by welding or otherwise affixing the accelerometer to the top surface of the bar 20. Alternatively, the accelerometer may be embedded in or covered by the elastomeric material of the casing 50. The accelerometer may wirelessly or via wire or via fiber transmit information regarding movement or vibration of the blade 10 to a receiver or controller for storing the data for later analysis or other use or for immediate use in connection with introducing active vibration cancellation systems or other immediate uses.

While exemplary embodiments have been presented in the foregoing description of the invention, it should be appreciated that a vast number of variations within the scope of the invention may exist. The foregoing examples are not intended to limit the nature or the scope of the invention in any way. Rather, the foregoing detailed description provides those skilled in the art with a foundation for implementing other exemplary embodiments of the invention.

We claim:

1. A replaceable blade adapted to be mounted to a lower edge of a moldboard, the blade comprising:

an elongate, substantially rigid bar possessing a substantially rectangular cross-section taken in a plane perpendicular to the direction of elongation, said bar possessing a top surface, a bottom surface, a back surface, a front surface, a first end surface, and a second end surface, wherein the back surface and the front surface of said bar are each substantially planar and co-parallel, each of said surfaces combining to define an outer peripheral surface;

an elastomeric material substantially completely encasing said bar, said elastomeric material possessing an interior peripheral surface in intimate contact with substantially the complete outer peripheral surface of said bar, and said elastomeric material possessing an outer peripheral surface substantially completely surrounding said bar;

an elongate, substantially rigid cover plate possessing a substantially rectangular cross-section taken in a plane perpendicular to the direction of elongation, said plate possessing a top surface, a bottom surface, a back surface, a front surface, a first end surface, and a second end surface, wherein the back surface and the front surface of said plate are each substantially planar and co-parallel, wherein the back surface of said plate is substantially co-parallel with the front surface of said bar, wherein the top surface, the bottom surface, the first end surface, and the second end surface of said plate together create a first plate peripheral profile, wherein the back surface of said plate is disposed against the outer peripheral surface of said elastomeric material surrounding said bar in the region of the front surface of said bar, wherein the outer peripheral surface of said elastomeric material possesses a recessed area possessing a configuration matching the first plate peripheral profile, and wherein said plate is conformingly and intimately received within the recessed area of said elastomeric material;

a plurality of aperture means each extending coextensively through said bar, said elastomeric material, and said plate for permitting an associated connector to extend therethrough by which said blade may be selectively mounted to the lower edge of a moldboard.

2. The replaceable blade according to claim 1 wherein said bar is configured to extend substantially completely along the lower edge of a moldboard and said blade further comprises a cutting edge mounted to and extending beneath substantially the entire bottom surface of said bar.

3. The replaceable blade according to claim 2 wherein the bottom surface of said bar possesses a substantially "U"-shaped groove extending substantially completely therealong and wherein said cutting edge is disposed in and substantially completely along the groove.

4. The replaceable blade according to claim 3 wherein said bar possesses walls defining the groove and wherein said cutting edge is mounted to the bottom surface of said bar and secured within the groove by press fit compression of said cutting edge with the walls defining the groove.

5. The replaceable blade according to claim 4 wherein said cutting edge possesses a bottom surface, wherein the bottom surface of said cutting edge is beveled.

6. The replaceable blade according to claim 5 wherein only the portion of the bottom surface of said bar between the groove and the back surface thereof is beveled, the beveled portion extends substantially completely along said bar, and the beveled portion of the bottom surface of said cutting edge and the beveled bottom surface of said bar are substantially co-extensive and co-planar.

7. The replaceable blade according to claim 2 wherein said bar is fashioned of metal, wherein said elastomeric material is fashioned of polyurethane, wherein said plate is fashioned of metal, and wherein said cutting edge is fashioned of carbide metal.

8. The snowplow blade according to claim 1 wherein either the front surface of the bar or the back surface of the bar or both are formed with a series of spaced ridges.

9. A snowplow blade comprising:

a metal bar possessing a substantially rectangular profile defined by a first length and a first width, and possessing a front surface and a back surface;

a metal plate possessing a substantially rectangular profile defined by a second length and a second width, and possessing a front surface and a back surface, the first length being substantially in the range of 1-5 percent greater than the second length, and the first width being substantially in the range of 4-15 percent greater than the second width; and a unitary, integral elastomeric material covering and adhered to substantially the entire front surface and the entire back surface of said bar and covering and adhered to substantially the entire back surface of said plate, but neither covering nor adhered to substantially any portion of the front surface of said plate, said elastomeric material covering the front surface of said bar provided with a recessed region possessing a configuration corresponding to the rectangular profile of said plate and the back surface of said plate, said plate disposed in the recessed region such that said elastomeric material covering the front surface of said bar is disposed between the back surface of said plate and the front surface of said bar.

10. The snowplow blade according to claim 9 wherein said bar, said plate, and said elastomeric material each possess at least one set of aligned apertures adapted to receive a bolt therethrough.

11. The snowplow bade according to claim 9 wherein said bar possesses a lower surface extending substantially completely along the length of said bar and wherein the blade further comprises a cutting edge affixed to said bar and extending substantially completely along the lower edge thereof.

12. The snowplow blade according to claim 11 wherein the lower surface of said bar possesses a groove therein defined by walls and wherein said cutting edge is secured to said bar by compression of said cutting edge with the walls defining the groove.

13. The snowplow blade according to claim 9 wherein either the front surface of the bar or the back surface of the bar or both are formed with a series of spaced ridges.

14. A snowplow blade adapted to be mounted to a moldboard, said blade comprising:

a metal bar possessing a substantially planar front surface;

a metal plate possessing a substantially planar back surface and possessing a plate peripheral profile; and an elastomeric material interposed between said bar and said plate, said elastomeric material having a first surface in intimate contact with and adhered to substantially the entire front surface of said bar and a second surface in intimate contact with and adhered to substantially the entire back surface of said plate, the second surface of said elastomeric material possessing a recessed area possessing a configuration matching the plate peripheral profile, and wherein said plate is conformingly and intimately received within the recessed area of the second surface of said elastomeric material, each of said bar, said plate and said elastomeric material provided with a series of apertures extending transversely therethrough, each aperture in the series of apertures in each of said bar, said plate, and said elastomeric material aligning with a corresponding aperture in the series of apertures in each of the other two of said bar, said plate, and said elastomeric material so as to provide a series of through-holes in said blade through which a connecting member may extend and by which said blade may be mounted to the moldboard.

15. The snowplow blade according to claim 14 wherein said elastomeric material is unitary and integral.

16. The snowplow blade according to claim 15 wherein said bar possesses a back surface and wherein said elastomeric material is in intimate contact with and adheres to substantially the entire back surface of said bar.

17. The snowplow blade according to claim 14 wherein said bar possesses a back surface and wherein said elastomeric material is in intimate contact with and adheres to substantially the entire back surface of said bar.

18. The snowplow blade according to claim 14 further comprising a plurality of hollow, cylindrical bushings, each bushing extending into the aligned apertures of said bar and said elastomeric material.

19. The snowplow blade according to claim 14 wherein the front surface of said bar is substantially parallel with the back surface of said plate.

20. The snowplow blade according to claim 14 wherein said bar possesses a lower edge, said blade further comprising a cutting edge mounted to said bar and depending from the lower surface of said bar.

21. The snowplow blade according to claim 14 wherein said bar possesses a substantially planar back surface and wherein either the front surface of the bar or the back surface of the bar or both are formed with a series of spaced ridges.

* * * * *